US007021958B2

(12) United States Patent
Shindo et al.

(10) Patent No.: US 7,021,958 B2
(45) Date of Patent: Apr. 4, 2006

(54) CONNECTOR ASSURING MORE RELIABLE CONNECTION OF A CABLE

(75) Inventors: Takeshi Shindo, Tokyo (JP); Keizo Kai, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/970,072

(22) Filed: Oct. 21, 2004

(65) Prior Publication Data

US 2005/0090140 A1 Apr. 28, 2005

(30) Foreign Application Priority Data

Oct. 23, 2003 (JP) ..... 2003-363171

(51) Int. Cl.
*H01R 4/24* (2006.01)

(52) U.S. Cl. ..... 439/409; 439/405

(58) Field of Classification Search ..... 439/405, 439/409, 407, 423, 422, 469, 497, 260, 267; 174/94 R See application file for complete search history.

(56) References Cited

U.S. PATENT DOCUMENTS 4,062,616 A 12/1977 Shaffer et al.
4,461,528 A * 7/1984 Durand et al. ..... 439/409
5,435,747 A * 7/1995 Franckx et al. ..... 439/409
5,785,548 A * 7/1998 Capper et al. ..... 439/409

FOREIGN PATENT DOCUMENTS

| | | |
|---|---|---|
| GB | 1 209 452 | 10/1970 |
| JP | 50-146896 A | 11/1975 |
| JP | 62-77876 U | 5/1987 |
| JP | 10-69949 A | 3/1998 |
| JP | 11-214056 A | 8/1999 |
| JP | 11-317248 A | 11/1999 |
| JP | 11-345640 A | 12/1999 |
| JP | 2000-260497 A | 9/2000 |
| JP | 2001-28282 A | 1/2001 |
| WO | WO 00/69025 A1 | 11/2000 |

* cited by examiner

*Primary Examiner*—Alexander Gilman
(74) *Attorney, Agent, or Firm*—Frishauf, Holtz, Goodman & Chick, P.C.

(57) ABSTRACT

In a connector to be connected to a cable by an insulation displacement connection, a first housing has a holding portion for receiving the cable. A second housing holds a contact and coupled to the first housing with its rotation with respect to the first housing. The contact is adapted to be contact with a mating connector and has a pair of insulation displacement portions faced to each other with a gap and adapted to be connected to the cable by the insulation displacement connection. The holding portion is inserted into the gap following the rotation of the second housing so that the cable is clamped between each of the insulation displacement portions and the holding portion.

15 Claims, 12 Drawing Sheets

CONNECTOR ASSURING MORE RELIABLE CONNECTION OF A CABLE

This invention claims priority to prior Japanese patent application JP 2003-363171, the disclosure of which is incorporated herein by reference.

BACKGROUND OF THE INVENTION

This invention relates to a connector to be connected to any kind of cables including a coaxial cable and a thin cable.

A connector of the type is disclosed, for example, in Japanese Patent Application Publication (JP-A) No. H11-345640. The connector comprises a housing, a plurality of contacts held by the housing, and a movable operating lever. The cables are positioned to face the contacts. Thereafter, when the operating lever is operated, the cables are pressed against the contacts by a pressing portion as a part of the operating lever. Thus, the connector is connected to the cables.

The connector of the type is also disclosed, for example, in Japanese Patent Application Publications (JP-A) Nos. H11-317248 and 2000-260497.

However, in each of the connectors mentioned above, reliability of connection is insufficient because the cables are merely pressed against the contacts by the pressing portion of the operating lever.

SUMMARY OF THE INVENTION

It is therefore an object of the present invention to provide a connector capable of readily and reliably connecting a cable without increase of the number of parts by using a press-fitting technology which will herein be called an insulation displacement connection (IDC).

Other objects of the present invention will become clear as the description proceeds.

According to one aspect of the present invention, there is provided a connector to be connected to a cable by an insulation displacement connection, comprising a first housing having a holding portion for receiving the cable, a contact to be contacted with a mating connector, and a second housing holding the contact and coupled to the first housing with its rotation with respect to the first housing, the contact having a pair of insulation displacement portions faced to each other with a gap and adapted to be connected to the cable by the insulation displacement connection, the holding portion being inserted into the gap following the rotation of the second housing so that the cable is clamped between each of the insulation displacement portions and the holding portion.

Since the connector uses an insulation displacement connection technology, it will hereinafter be called an "insulation displacement connector".

DESCRIPTION OF THE PREFERRED EMBODIMENTS

At first referring to FIGS. 1A, 1B, 2A, 2B, and 3, description will be made of an insulation displacement connector according to a first embodiment of the present invention.

Figure 1A:
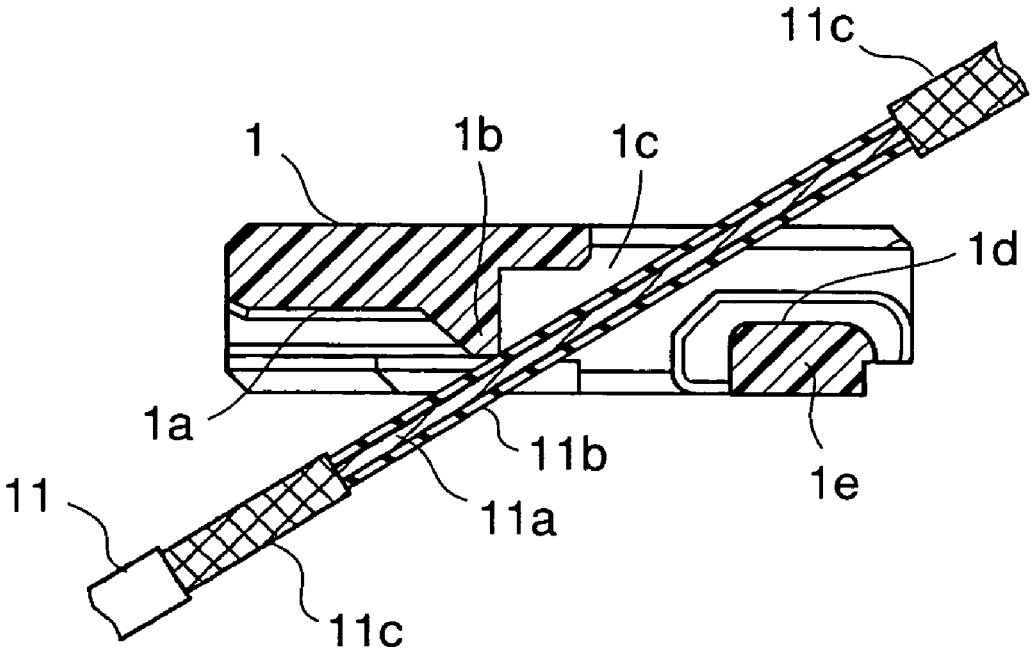
FIG. 1A is a sectional view of an insulation displacement connector according to a first embodiment of the present invention in the middle of an operation of attaching a plurality of coaxial cables to a first housing.

Referring to FIG. 1A, the Insulation displacement connector comprises a first housing 1 made of synthetic resin. The first housing 1 is provided with a plurality of grooves 1*a* formed at a left lower half portion thereof to receive a plurality of coaxial cables 11, respectively, and a protruding guide portion 1*b* having a generally triangular shape. The grooves 1*a* are formed at a predetermined pitch in a predetermined direction, i.e., a direction perpendicular to a drawing sheet. The first housing 1 has, at a right half portion, a space 1*c* and a plurality of grooves 1*d* both for receiving the coaxial cables 11, and a protruding guide portion 1*e* having a generally rectangular shape and serving as a holding portion. Each of the coaxial cables 11 comprises a conductive core wire 11*a* coated with a dielectric member 11*b* and a grounding external conductor 11*c* successively formed around the core wire 11*a*. Prior to connection to the Insulation displacement connector, the external conductor 11*c* at an end of each coaxial cable 11 is peeled off and removed.

Figure 1B:
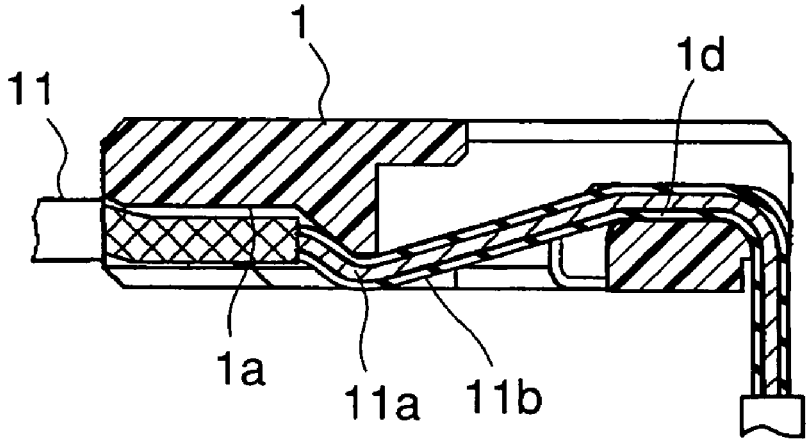
FIG. 1B is a sectional view similar to FIG. 1A after the coaxial cables are attached.

In the state illustrated in FIG. 1A, each of the coaxial cables 11 is press-fitted into the grooves 1*b* and 1*d* and arranged along the protruding guide portions 1*b* and 1*e*. Then, the state illustrated in FIG. 1B is reached. In this state, each coaxial cable 11 is applied with tension. Since the coaxial cable 11 is held in the groove 1*d* on the protruding guide portion 1*e*, the coaxial cable 11 is stable held in the first housing 1.

Figure 2A:
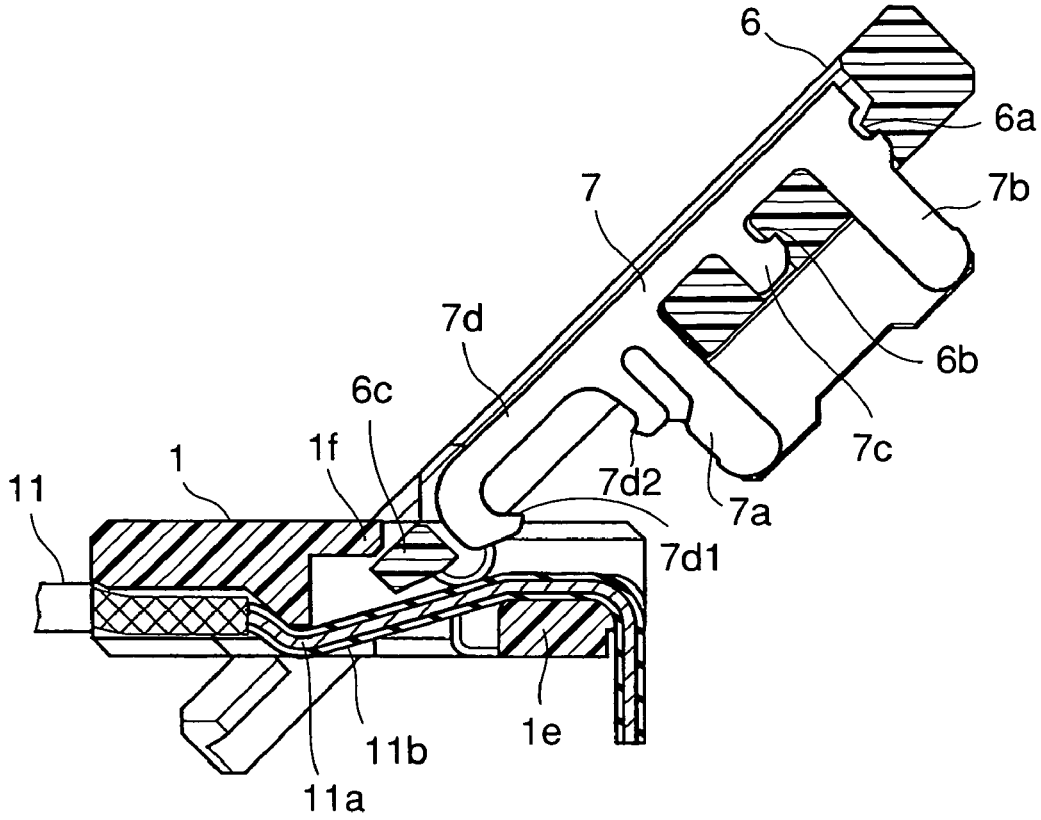
FIG. 2A is a sectional view showing an initial stage of a connecting operation of connecting the coaxial cables to the insulation displacement connector.

Referring to FIG. 2A, the Insulation displacement connector further comprises a second housing 6 made of synthetic resin and a plurality of conductive contacts 7 held by the second housing 6 and arranged at a predetermined pitch in the predetermined direction. The second housing 6 is provided with a plurality of press-fit grooves 6*a* and 6*b* formed at a predetermined pitch in a direction perpendicular to the drawing sheet to hold the contacts 7, and a pivot point portion 6*c* serving as a pivot point or center of rotation when the second housing 6 is rotated with respect to the first housing 1. Each contact 7 has a pair of connection terminal portions 7*a* and 7*b*, a fixing portion 7*c*, and a press-contacting terminal portion 7*d*. The press-contacting terminal portion 7*d* is provided with a pair of first and second blade shape portions 7*d*1 and 7*d*2 faced to each other with a gap. The first and the second blade shape portions 7*d*1 and 7*d*2 are referred to as press-contacting portions or insulation displacement contact portions, respectively. The connection terminal portion 7*b* and the fixing portion 7*c* of each contact 7 are press-fitted into the press-fit grooves 6*a* and 6*b* of the second housing 6, respectively.

As illustrated in FIG. 2A, the second housing 6 is inserted into the first housing 1 in an inclined position. In this state, the second housing 6 is rotated clockwise around the pivot point portion 6*c* (herein, the pivot point portion 6*c* is slightly moved during rotation). Then, the pivot point portion 6*c* is butted against a protruding support portion 1*f* of the first housing 1 and the second housing 6 is rotatably moved through the state illustrated in FIG. 2B to the state illustrated in FIG. 3. Eventually, the protruding guide portion 1*e* is inserted into the gap between the first and the second blade shape portions 7*d*1 and 7*d*2 so that the cable 11 is clamped between each of the first and the second blade shape portions 7*d*1 and 7*d*2 and the protruding guide portion 1*e*.

Following the rotatable movement of the second housing 6, the first and the second blade shape portions 7*d*1 and 7*d*2 of each contact 7 break the dielectric member 11*b* of each coaxial cable 11 and penetrate through the dielectric member 11*b* to be press-contacted with the core wire 1*a*. Thus, each contact 7 is electrically connected to each coaxial cable 11 by using a press-fitting technology which is similar to an insulation displacement connection (IDC) known in the art and therefore will also be called herein an insulation displacement connection.

More particularly, the blade shape portions 7*d*1 and 7*d*2 easily break the dielectric member 11*b* of the coaxial cable 11 and clamp both of the protruding guide portion or holding portion 1*e* of the first housing 1 and the coaxial cable 11. Because mutual contact is established by the insulation displacement contact portions (7*d*1, 7*d*2), the contact 7 is reliably connected to the coaxial cable 11. Since the contact 7 is connected to the coaxial cable 11 at two positions, connection is more reliable. Thereafter, the connection terminal portions 7*a* and 7*b* of the Insulation displacement connector are connected to corresponding connection terminal portions of a mating connector (not shown).

Next referring to FIGS. 4, 4A, 4B, 5A, and 5B, description will be made of an Insulation displacement connector according to a second embodiment of the present invention. Similar parts are designated by like reference numerals and description thereof will be omitted.

The Insulation displacement connector further comprises a conductive ground bar 8 held by the first housing 1. The ground bar 8 has a pair of side portions 8*a* and a coupling portion 8*b* in the shape of a rectangular frame coupling the side portions 8*a* to each other. Each of the side portions 8*a* has an integral structure including a press-fit portion 8*a*1, a first linear coupling portion 8*a*2, a U-shaped portion 8*a*3, and a second linear coupling portion 8*a*4, and a L-shaped portion 8*a*5.

Figure 4C:
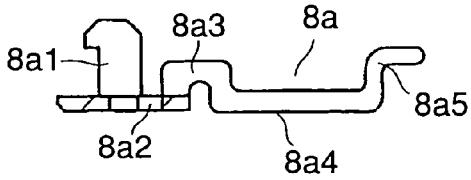
FIG. 4C is a side view of a ground bar used in FIG. 4B.
Figure 4:
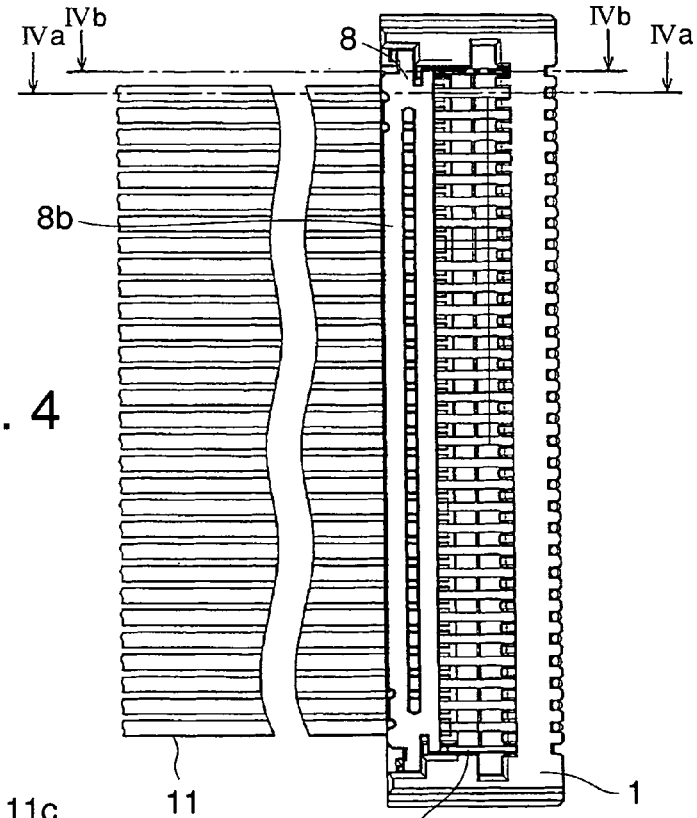
FIG. 4 is a plan view of an insulation displacement connector according to a second embodiment of the present invention when a plurality of coaxial cables are attached to a first housing.
Figure 4A:
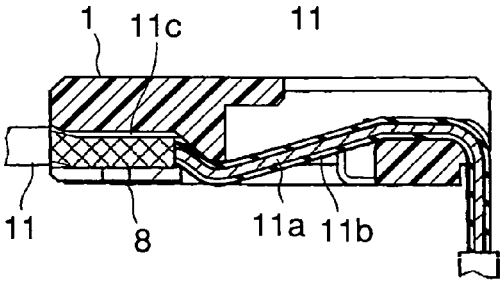
FIG. 4A is an enlarged sectional view taken along a line IVa—IVa in FIG. 4.
Figure 4B:
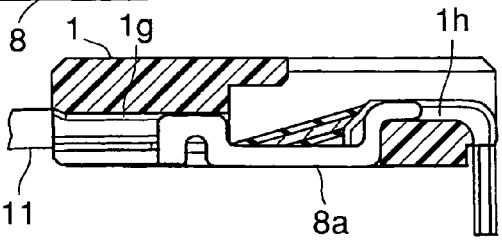
FIG. 4B is an enlarged sectional view taken along a line IVb—IVb in FIG. 4.

The ground bar 8 is attached to the first housing 1 in the following manner. The press-fit portion 8*a*1 of each side portion 8*a* is press-fitted into each groove (not shown) formed on the first housing 1. At this time, the U-shaped portion 8*a*3 and the L-shaped portion 8*a*5 are inserted into grooves 1*g* and 1*h* formed on the first housing 1, respectively. Then, each side portion 8*a* is put into the state illustrated in FIG. 4B. As illustrated in FIG. 4, an upper surface of the coupling portion 8*b* of the ground bar 8 and the external conductor 11*c* of each coaxial cable 11 are soldered.

Figure 5A:
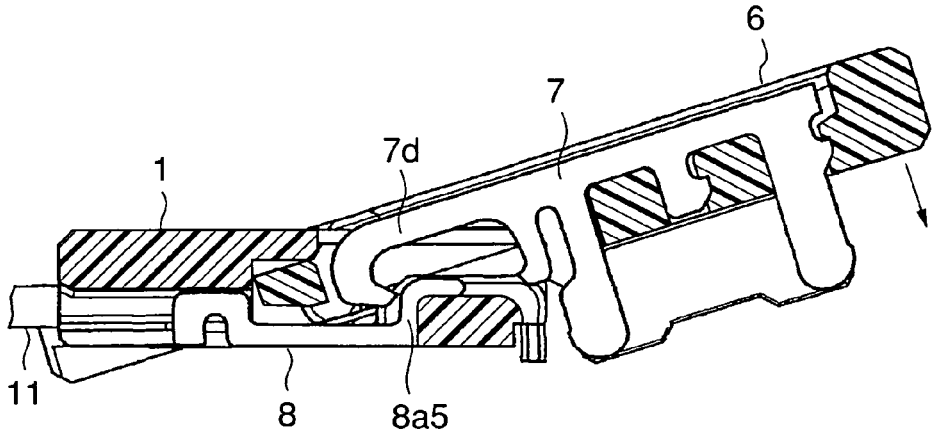
FIG. 5A is a sectional view showing an intermediate stage of a connecting operation of connecting the coaxial cables to the insulation displacement connector.
Figure 5B:
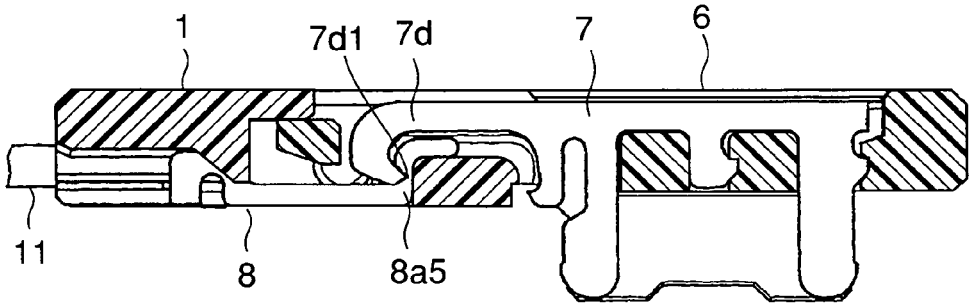
FIG. 5B is a sectional view similar to FIG. 5A after completion of the connecting operation.
Figure 6A:
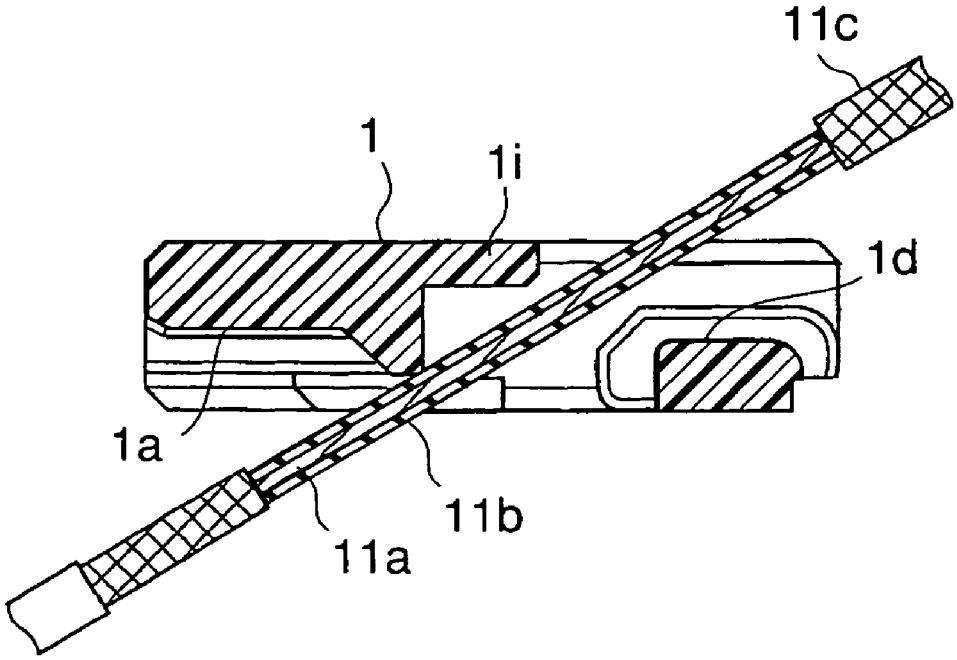
FIG. 6A is a sectional view of an insulation displacement connector according to a third embodiment of the present invention in the middle of an operation of attaching a plurality of coaxial cables to a first housing.
Figure 6B:
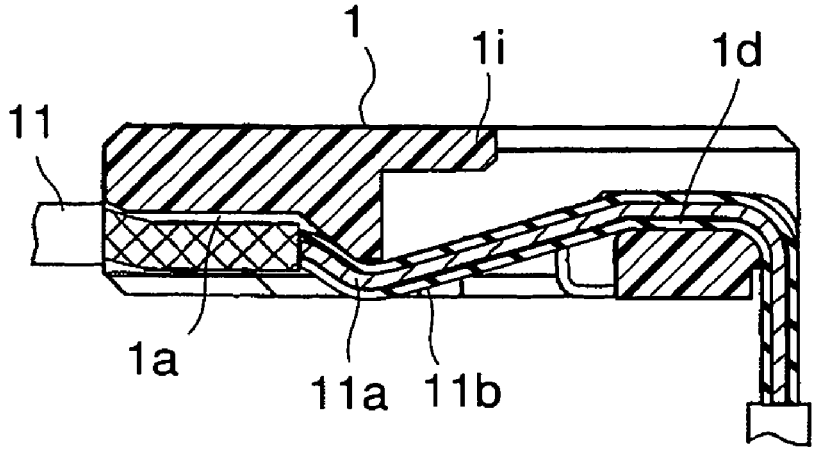
FIG. 6B is a sectional view after the coaxial cables are attached.

Thereafter, the second housing 6 is inserted into the first housing 1 in an inclined position as illustrated in FIG. 5A and is rotated with respect to the first housing 1 to the state illustrated in FIG. 5B. Then, the first blade shape portions 7*d*1 of the contacts 7 arranged at opposite ends in the predetermined direction bite into the L-shaped portion 8*a*5 of the ground bar 8. Thus, a ground structure is formed.

Figure 2B:
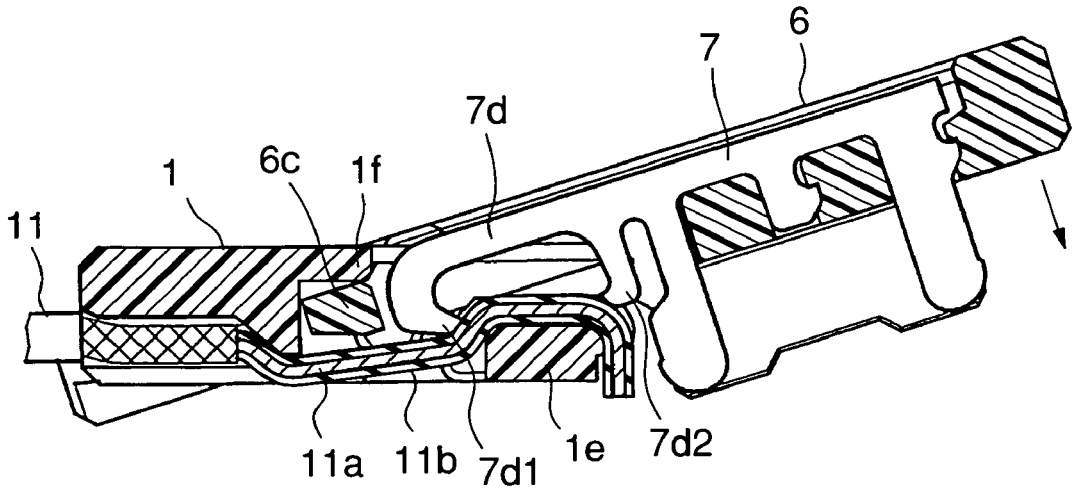
FIG. 2B is a sectional view similar to FIG. 2A in the middle of the connecting operation.
Figure 3:
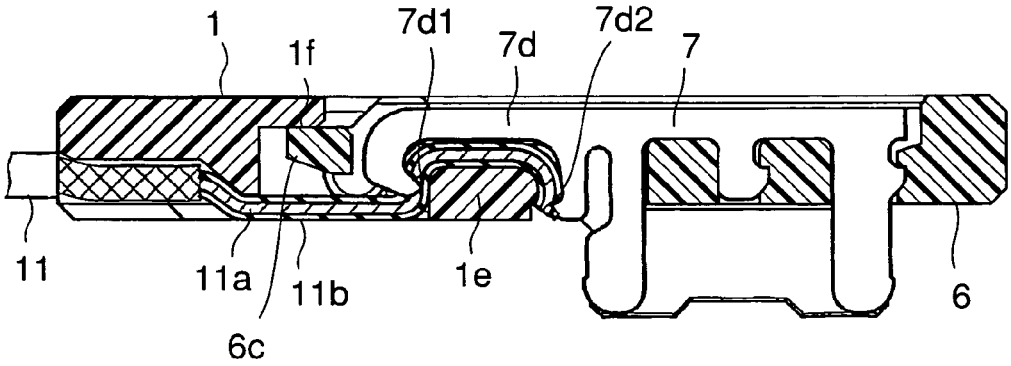
FIG. 3 is a sectional view similar to FIG. 2A after completion of the connecting operation.

In each of the remaining contacts 7, the first and the second blade shape portions 7*d*1 and 7*d*2 break the dielectric member 11*b* of each coaxial cable 11 to be press-contacted with the core wire 11*a*, as illustrated in FIG. 2B. As a result, the blade shape portions 7*d*1 and 7*d*2 clamp both of the protruding guide portion 1*e* of the first housing 1 and the coaxial cable 11. Thus, each contact 7 is electrically connected to each coaxial cable 11.

Referring to FIGS. 6A, 6B, 7A, 7B, and 8, description will be made of an Insulation displacement connector according to a third embodiment of the present invention. Similar parts are designated by like reference numerals and description thereof will be omitted.

In the Insulation displacement connector, the first housing 1 has a protruding support portion 1*i* which protrudes relatively high. Each contact 7 is provided with a disengagement-prevention protruding portion 7*d*3 formed on a side opposite to the first blade shape portion 7*d*1 of the insulation displacement terminal portion 7*d*.

Figure 7A:
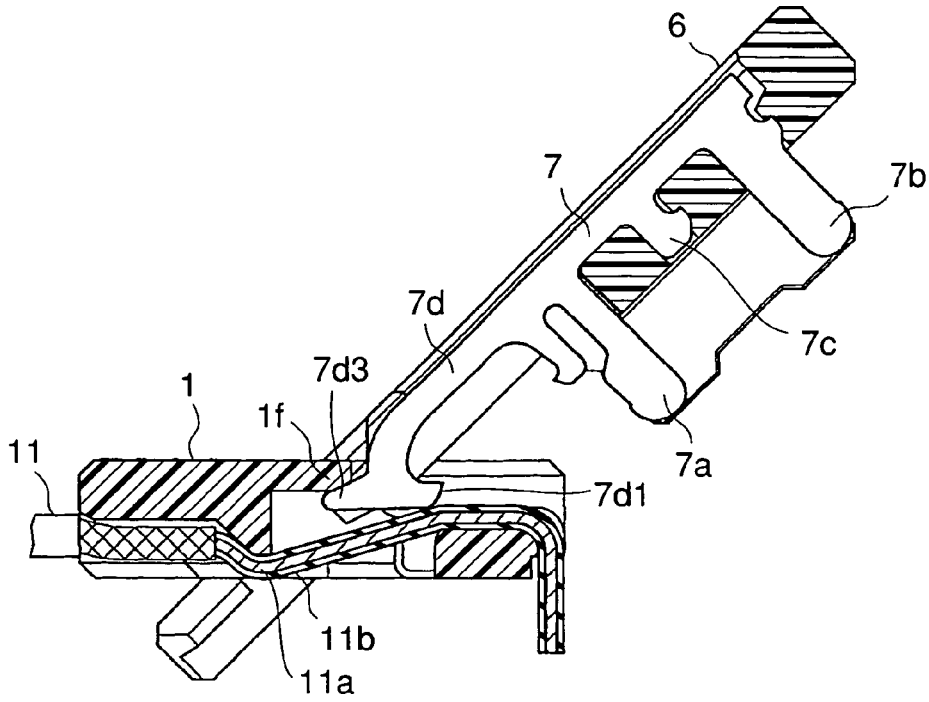
FIG. 7A is a sectional view showing an intermediate stage of a connecting operation of connecting the coaxial cables to the insulation displacement connector.
Figure 7B:
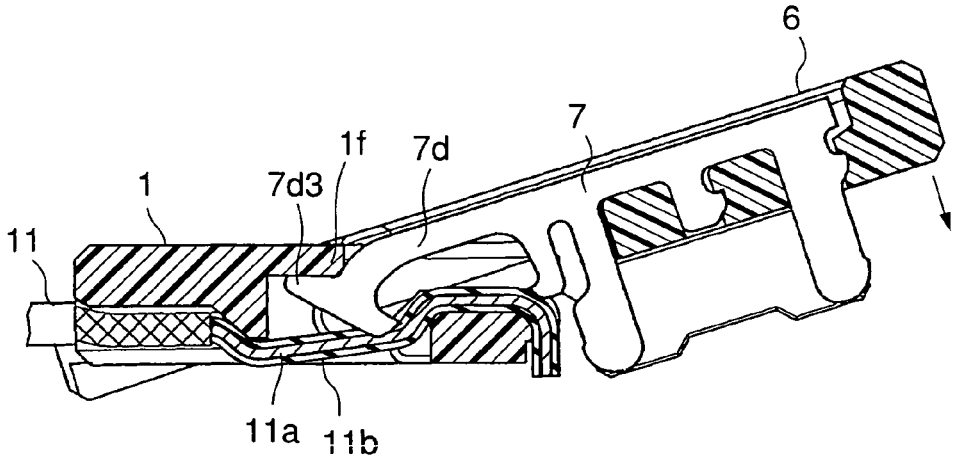
FIG. 7B is a sectional view similar to FIG. 7A after completion of the connecting operation.
Figure 8:
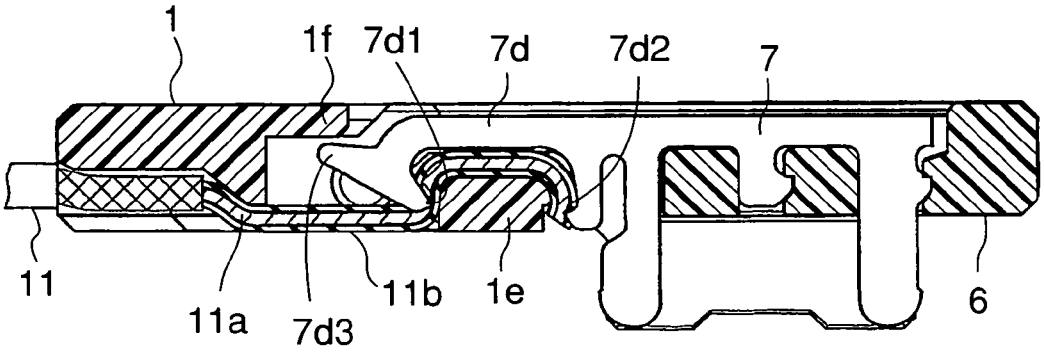
FIG. 8 is a sectional view similar to FIG. 7A after completion of the connecting operation.
Figure 9:
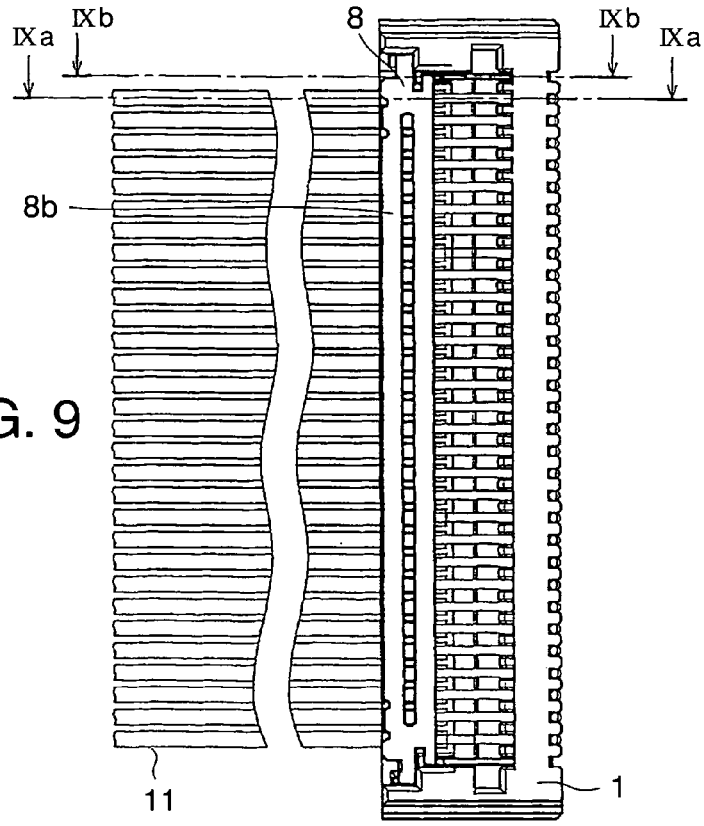
FIG. 9 is a plan view of an insulation displacement connector according to a fourth embodiment of the present invention when a plurality of coaxial cables are attached to a first housing.
Figure 9A:
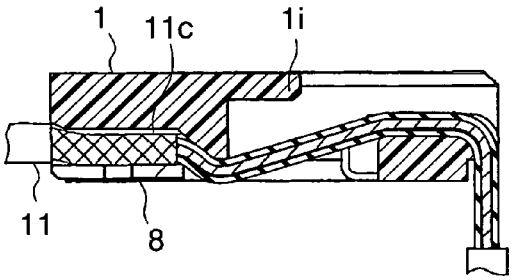
FIG. 9A is an enlarged sectional view taken along a line IXa—IXa in FIG. 9.
Figure 9B:
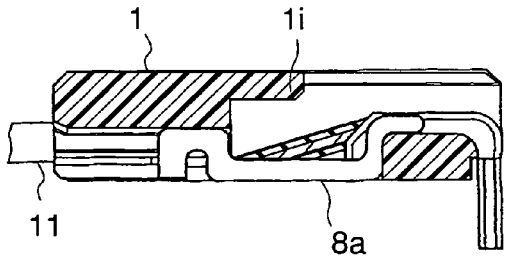
FIG. 9B is an enlarged sectional view taken along a line IXb—IXb in FIG. 9.

The second housing 6 is inserted into the first housing 1 in an inclined position as illustrated in FIG. 7A and rotated with respect to the first housing 1 to the state illustrated in FIG. 8. Then, the first and the second blade shape portions 7*d*1 and 7*d*2 of each contact 7 break the dielectric member 11*b* of each coaxial cable 11 to be press-contacted with the core wire 11*a*. As a result, the first and the second blade shape portions 7*d*1 and 7*d*2 clamp both of the protruding guide portion 1*e* of the first housing 1 and the coaxial cable 11. Thus, each contact 7 is electrically connected to each coaxial cable 11. When the second housing 6 is rotated, the disengagement-prevention protruding portion 7*d*3 is butted against the protruding support portion 1*f* and is prevented from being disengaged from the protruding support portion 1*f*.

Referring to FIGS. 9, 9A, 9B, 10A, and 10B, description will be made of an Insulation displacement connector according to a fourth embodiment of the present invention. Similar parts are designated by like reference numerals and description thereof will be omitted.

In the Insulation displacement connector, the first housing 1 has the protruding support portion 1*i* and the contact 7 has the disengagement-prevention protruding portion 7*d*3.

Figure 10A:
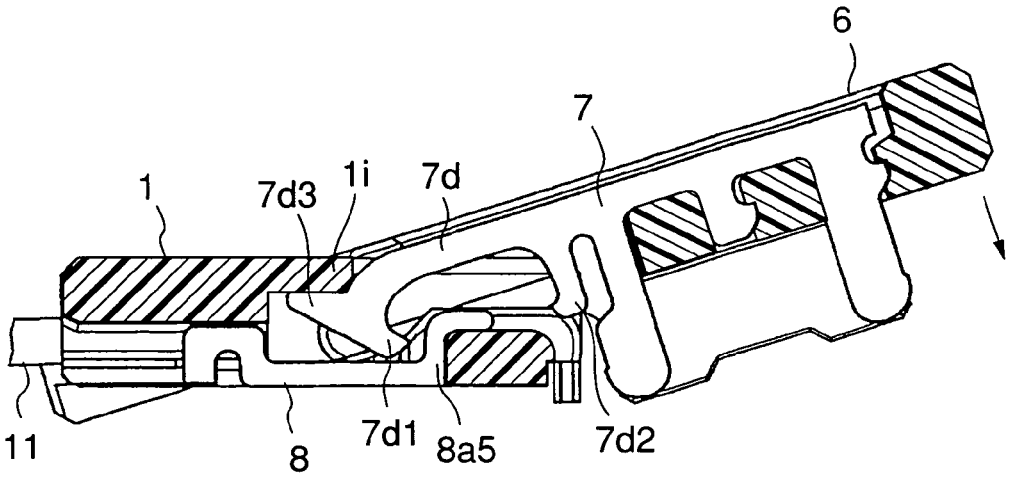
FIG. 10A is a sectional view showing an intermediate stage of a connecting operation of connecting the coaxial cables to the insulation displacement connector.
Figure 10B:
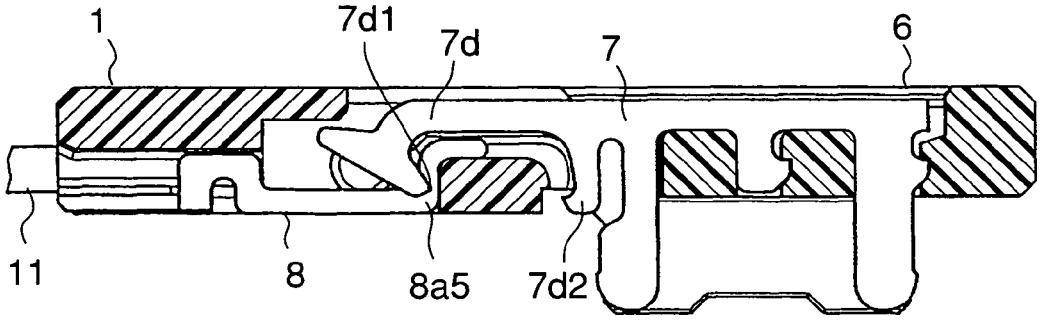
FIG. 10B is a sectional view similar to FIG. 10A after completion of the connecting operation.

The second housing 6 is inserted into the first housing 1 in an inclined portion as illustrated in FIG. 10A and rotated with respect to the first housing 1 to the state illustrated in FIG. 10B. Then, the first blade shape portions 7*d*1 of the contacts 7 arranged at opposite ends in the predetermined direction bite into the L-shaped portion 8*a*5 of the ground bar 8. Thus, a ground structure is formed.

In each of the remaining contacts 7, the first and the second blade shape portions 7*d*1 and 7*d*2 break the dielectric member 11*b* of each coaxial cable 11 to be press-contacted with the core wire 11*a*, as illustrated in FIG. 2B. As a result, the blade shape portions 7*d*1 and 7*d*2 clamp both of the protruding guide portion 1*e* of the first housing 1 and the coaxial cable 11. Thus, each contact 7 is electrically connected to each coaxial cable 11. When the second housing 6 is rotated, the disengagement-prevention protruding portion 7*d*3 is butted against the protruding support portion 1*f* and is more reliably prevented from being disengaged from the protruding support portion 1*f*.

Figure 11:
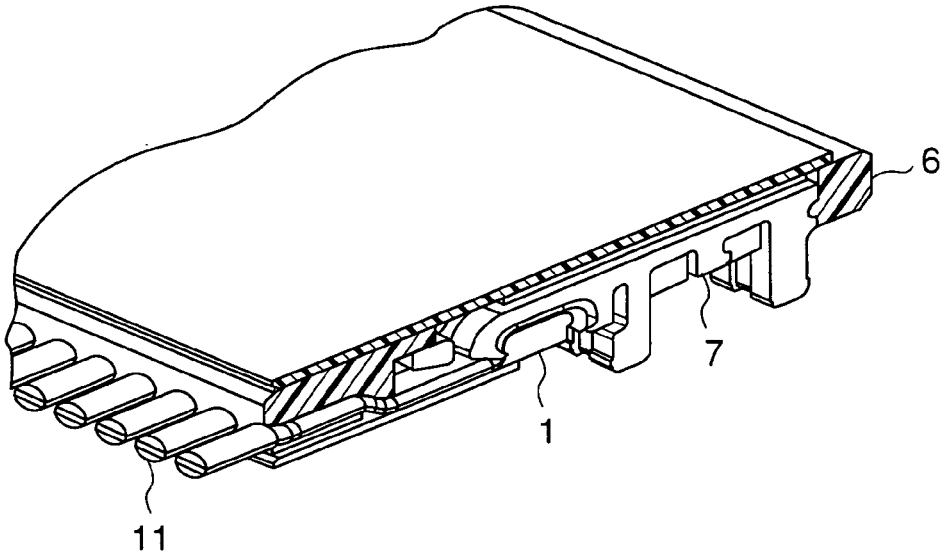
FIG. 11 is a perspective view showing the state where coaxial cables are connected to a selected one of the insulation displacement connectors according to the first through the fourth embodiments of the present invention.
Figure 12:
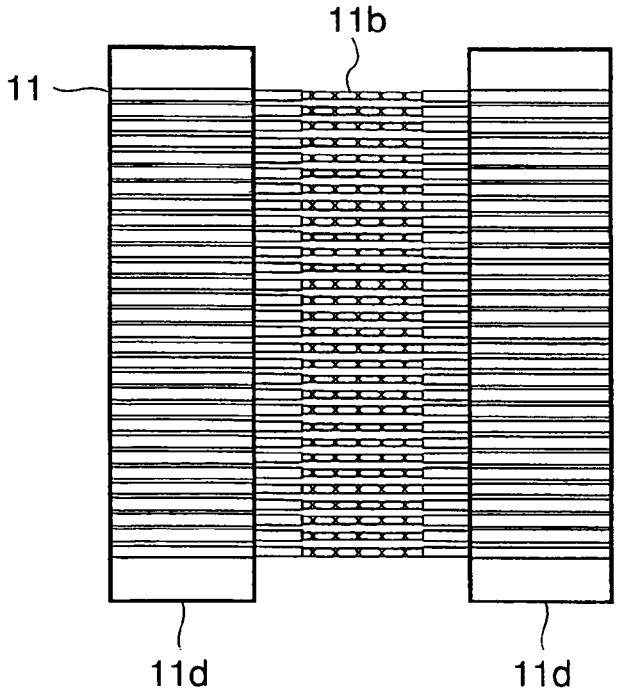
FIG. 12 is a front view of an example of a flat cable comprising a plurality of coaxial cables.
Figure 13:
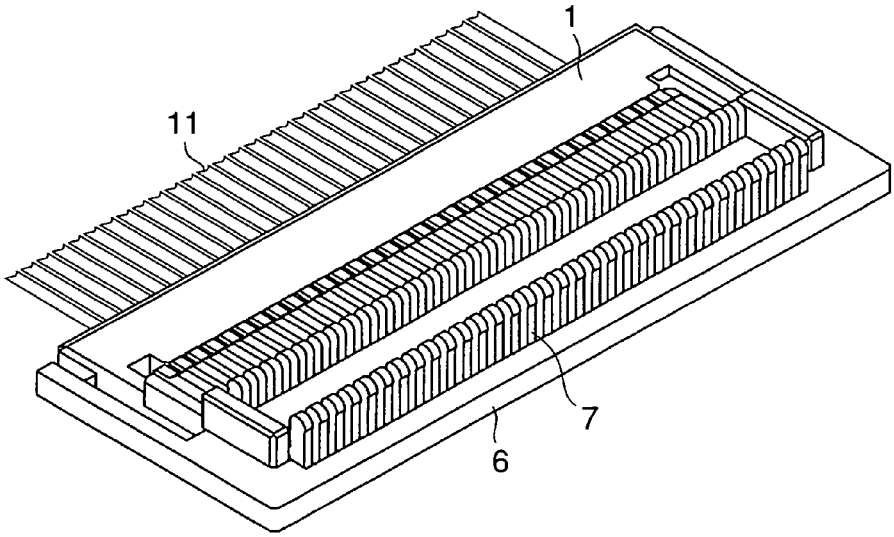
FIG. 13 is a perspective view of an insulation displacement connector according to a fifth embodiment of the present invention when a plurality of coaxial cables are connected thereto.
Figure 14B:
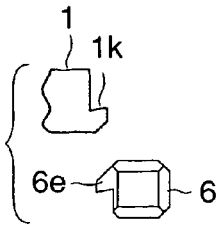
FIG. 14B is an end view corresponding to FIG. 14A as seen in a direction depicted by an arrow XIV.
Figure 14A:
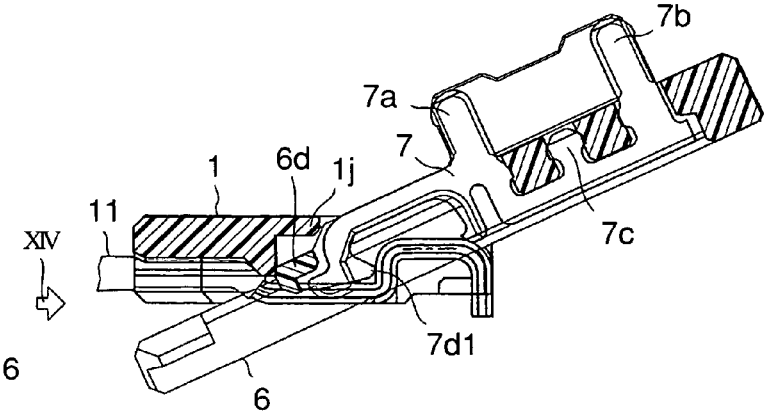
FIG. 14A is a sectional view showing an intermediate stage of a connecting operation of connecting the coaxial cables to the insulation displacement connector in FIG. 13.
Figure 15B:
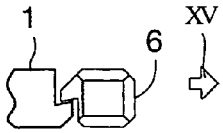
FIG. 15B is an end view corresponding to FIG. 15A as seen in a direction depicted by an arrow XV.
Figure 15A:
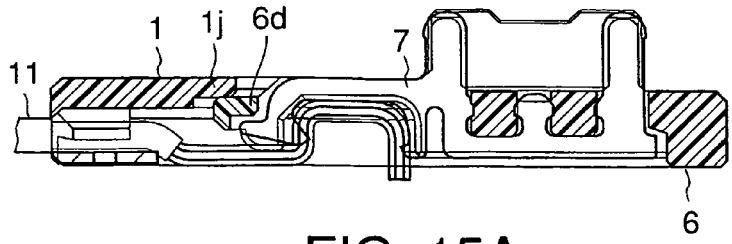
FIG. 15A is a sectional view after completion of the connecting operation.

In each of the Insulation displacement connectors of the above-mentioned four types, when the coaxial cables 11 are connected, the state illustrated in FIG. 11 is generally attained. As the coaxial cables 11, use may be made of a flat cable as illustrated in FIG. 12. In the flat cable illustrated in the figure, the coaxial cables 11 are arranged on a single plane with opposite ends fixed by film-like sheets 11*d* to leave the dielectric member 11*b* at the center in an exposed state.

Referring to FIGS. 13, 14A, 14B, 15A, and 15B, description will be made of an Insulation displacement connector according to a fifth embodiment of the present invention. Similar parts are designated by like reference numerals and description thereof will be omitted.

In the Insulation displacement connector, the connection terminal portions 7*a* and 7*b* and the fixing portion 7*c* of each contact 7 are oriented in a direction reverse to that in the foregoing embodiments. In addition, the first blade shape portion 7*d*1 also serves as the center of rotation or the pivot point. The second housing 6 is provided with a stopped portion 6*d* while the first housing 1 is provided with the protruding support portion 1*i* for locking the stopped portion 6*d*. Further, the first housing 1 is provided with a locking portion 1*k* while the second housing 6 is provided with a locked portion 6*e*.

In each of the insulation displacement connectors described above, each contact 7 is produced from a metal thin plate. Each of the grooves 1*a*, 1*d*, 1*g*, and 1*h* of the first housing may be formed into an appropriate shape, such as a V shape or a U shape.

While the present invention has thus far been described in conjunction with the preferred embodiments thereof, it will be readily possible for those skilled in the art to put this invention into practice in various other manners without departing from the scope of this invention.

What is claimed is:

1. A connector to be connected to a cable by an insulation displacement connection, said connector comprising;

a first housing including a holding portion for receiving the cable;

a contact to contact a mating connector and which includes a pair of insulation displacement portions that face each other with a gap therebetween and that are adapted to be connected to the cable by the insulation displacement connection; and a second housing which holds the contact and which is coupled to the first housing;

wherein the second housing is rotatable with respect to the first housing to insert the holding portion into the gap so as to clamp the cable between the holding portion and each of the insulation displacement portions;

wherein the second housing comprises a pivot point portion, and the first housing comprises a support portion for supporting the pivot point portion; and wherein the insulation displacement contact portions comprise a first blade-shaped portion and a second blade-shaped portion farther from the pivot point portion than the first blade-shaped portion, the holding portion comprises a recessed portion facing the second blade-shaped portion, and a part of the cable is bent towards the recessed portion.

2. The connector according to claim 1, wherein the cable comprises a coaxial cable, and the contact comprises a signal contact to be connected to a core wire of the coaxial cable.

3. The connector according to claim 1, wherein the cable comprises a coaxial cable including a core wire and an external conductor insulated from the core wire, the insulation displacement portions are connected to the core wire such that the contact functions as a signal contact, and the connector further comprises:

a ground bar held by the first housing to be connected to the external conductor; and a ground contact held by the second housing to be connected to the ground bar following the rotation of the second housing.

4. A connector to be connected to a cable by an insulation displacement connection, said connector comprising:

a first housing including a holding portion for receiving the cable;

a contact to contact a mating connector and which includes a pair of insulation displacement portions that face each other with a gap therebetween and that are adapted to be connected to the cable by the insulation displacement connection; and a second housing which holds the contact and which is coupled to the first housing;

wherein the second housing is rotatable with respect to the first housing to insert the holding portion into the gap so as to clamp the cable between the holding portion and each of the insulation displacement portions; and wherein the contact comprises a pivot point portion, and the first housing comprises a support portion for supporting the pivot point portion.

5. The connector according to claim 4, wherein the insulation displacement contact portions comprise a first blade-shaped portion and a second blade-shaped portion farther from the pivot point portion than the first blade-shaped portion, the holding portion comprises a recessed portion facing the second blade-shaped portion, and a part of the cable is bent towards the recessed portion.

6. The connector according to claim 4, wherein each of the insulation displacement contact portions comprises a blade-shaped portion.

7. The connector according to claim 4, wherein the holding portion comprises a groove for receiving the cable.

8. The connector according to claim 4, wherein the cable comprises a coaxial cable including a core wire and an external conductor insulated from the core wire, the insulation displacement portions are connected to the core wire such that the contact functions as a signal contact, and the connector further comprises:

a ground bar held by the first housing to be connected to the external conductor; and a ground contact held by the second housing to be connected to the ground bar following the rotation of the second housing.

9. The connector according to claim 4, wherein the cable comprises a coaxial cable, and the contact comprises a signal contact to be connected to a core wire of the coaxial cable.

10. A connector to be connected to a coaxial cable by an insulation displacement connection, said connector comprising:

a first housing including a holding portion for receiving the cable;

a signal contact to contact a mating connector and to be connected to a core wire of the coaxial cable, and which includes a pair of insulation displacement portions that face each other with a gap therebetween and that are adapted to be connected to the cable by the insulation displacement connection;

a second housing which holds the contact and which is coupled to the first housing;

a ground bar held by the first housing to be connected to an external conductor of the coaxial cable; and a ground contact held by the second housing to be connected to the ground bar;

wherein the second housing is rotatable with respect to the first housing to insert the holding portion into the gap so as to clamp the cable between the holding portion and each of the insulation displacement portions.

11. The connector according to claim 10, wherein the second housing comprises a pivot point portion, and the first housing comprises a support portion for supporting the pivot point portion.

12. The connector according to claim 10, wherein the contact comprises a pivot point portion, and the first housing comprises a support portion for supporting the pivot point portion.

13. The connector according to claim 10, wherein the insulation displacement contact portions comprise a first blade-shaped portion and a second blade-shaped portion farther from the pivot point portion than the first blade-shaped portion, the holding portion comprises a recessed portion facing the second blade-shaped portion, and a part of the cable is bent towards the recessed portion.

14. The connector according to claim 10, wherein each of the insulation displacement contact portions comprises a blade-shaped portion.

15. The connector according to claim 10, wherein the holding portion comprises a groove for receiving the cable.

* * * * *